US012139987B1

(12) United States Patent
Wilson et al.

(10) Patent No.: US 12,139,987 B1
(45) Date of Patent: Nov. 12, 2024

(54) DOWNHOLE TUBULAR DISCONNECT ASSEMBLIES

(71) Applicants: Paul James Wilson, Cypress, TX (US); Robert Bradley Cook, Mandeville, LA (US); Daniel Teen, Mandeville, LA (US); Glenn Mitchel Walls, Madisonville, LA (US)

(72) Inventors: Paul James Wilson, Cypress, TX (US); Robert Bradley Cook, Mandeville, LA (US); Daniel Teen, Mandeville, LA (US); Glenn Mitchel Walls, Madisonville, LA (US)

( * ) Notice: Subject to any disclaimer, the term of this patent is extended or adjusted under 35 U.S.C. 154(b) by 0 days.

(21) Appl. No.: 17/024,642

(22) Filed: Sep. 17, 2020

Related U.S. Application Data

(63) Continuation-in-part of application No. 16/031,978, filed on Jul. 10, 2018, now abandoned.

(60) Provisional application No. 62/531,141, filed on Jul. 11, 2017.

(51) Int. Cl.
*E21B 29/02* (2006.01)

(52) U.S. Cl.
CPC ..... *E21B 29/02* (2013.01)

(58) Field of Classification Search
CPC ..... E21B 29/02
See application file for complete search history.

(56) References Cited

U.S. PATENT DOCUMENTS

| | | | | |
|---|---|---|---|---|
| 5,323,853 | A * | 6/1994 | Leismer | E21B 23/04 166/377 |
| 6,269,883 | B1 * | 8/2001 | Gissler | E21B 47/092 166/241.5 |
| 10,669,799 | B2 * | 6/2020 | Massey | E21B 31/002 |
| 10,781,676 | B2 * | 9/2020 | Huang | E21B 43/114 |
| 2012/0031615 | A1 * | 2/2012 | Connell | E21B 43/114 166/55 |
| 2014/0060854 | A1 * | 3/2014 | Baudoin | E21B 17/06 166/242.6 |
| 2015/0233219 | A1 * | 8/2015 | Bell | E21B 43/117 166/299 |
| 2017/0335646 | A1 * | 11/2017 | Huang | E21B 34/063 |
| 2019/0330947 | A1 * | 10/2019 | Mulhern | E21B 23/0414 |
| 2021/0189818 | A1 * | 6/2021 | Schultz | E21B 34/142 |

* cited by examiner

*Primary Examiner* — Taras P Bemko
(74) *Attorney, Agent, or Firm* — Elliott Law PLLC; Douglas H. Elliott; Nathan Q. Huynh

(57) ABSTRACT

Disclosed herein are downhole tubular disconnect assemblies. Those downhole tubular disconnect assemblies may each include: a parting sub having a thin wall section; a cutting segment coupled to an outer surface of the thin wall section; an ignition assembly coupled to the parting sub and the cutting segment; a sleeve disposed over the thin wall section of the parting sub and the cutting segment; and a cap coupled to the parting sub and abutted against the sleeve.

20 Claims, 11 Drawing Sheets

DOWNHOLE TUBULAR DISCONNECT ASSEMBLIES

CROSS REFERENCE TO RELATED APPLICATIONS

This application is a continuation-in-part of and claims benefit to co-pending U.S. non-provisional application Ser. No. 16/031,978, filed on Jul. 10, 2018, which claims benefit to U.S. provisional application 62/531,141, filed on Jul. 11, 2017; and this application hereby incorporates herein those applications and all amendments thereto as if set forth herein in their entireties.

BACKGROUND

1. Field of Inventions

The field of this application and any resulting patent is tubular disconnect assemblies.

2. Description of Related Art

Various downhole tubular disconnect assemblies and methods for disconnecting portions of a drill string, have been proposed and utilized, including some of the methods and structures disclosed in some of the references appearing on the face of this application. However, those methods and structures lack the combination of steps and/or features of the methods and/or structures covered by what is disclosed herein. Furthermore, it is contemplated that the methods and/or structures disclosed herein solve many of the problems that prior art methods and structures have failed to solve. Also, the methods and/or structures disclosed herein have benefits that would be surprising and unexpected to a hypothetical person of ordinary skill with knowledge of the prior art existing as of the filing date of this application.

SUMMARY

Disclosed herein are downhole tubular disconnect assemblies, which downhole tubular disconnect assemblies may each include: a parting sub having a decoupling portion; a cutting charge coupled to an outer surface of the decoupling portion; an ignition assembly coupled to the parting sub and the cutting charge; a sleeve disposed over the decoupling portion of the parting sub and the cutting charge; and an end cap coupled to the parting sub and abutted against the sleeve.

Additionally, disclosed herein are downhole tubular disconnect assemblies, which downhole tubular disconnect assemblies may each include: a parting sub having a decoupling portion and a groove; a cutting charge coupled to an outer surface of the decoupling portion; an ignition assembly coupled to the parting sub and the cutting charge, the ignition assembly comprising: a receiver coupled to an inner surface of the parting sub; a controller disposed in the groove of the parting sub and coupled to the receiver; a power pack disposed in the groove of the parting sub; an ignition head capable of igniting the cutting charge; and a sleeve covering the decoupling portion of the parting sub and the cutting charge; and an end cap coupled to the parting sub and abutted against the sleeve.

Also, disclosed herein are downhole tubular disconnect assemblies, which downhole tubular disconnect assemblies may each include: a tubular sub-section having an axially elongated thin wall section between stepped bosses at opposite ends thereof, the thin wall section and bosses having an axial flow bore therethrough, a first tread on a first boss of the bosses having a first diameter, a second boss of the bosses having second tread on an axially opposite side of the first boss from the thin wall section, the second boss second tread having a second outer diameter that is less than the first diameter, a third boss of the bosses having a third tread between the thin wall section and first step, the third tread having a third diameter less than the first diameter, the thin wall section having a base outer diameter that is less than the second and third outer diameters; an axially elongated sleeve having a first end and a second end, the first end having a first internal bore with a first inner diameter corresponding to a slip fit over the second tread on the bosses, the second end having a second internal bore with a second inner diameter corresponding to a slip fit over the third tread on the bosses; one or more cutting charges mounted on the periphery of the thin wall section; an ignitor configured to ignite and burn the one or more cutting charges, the burning of the one or more cutting charges generates cutting jets directed towards the outer surface of the thin wall section; and a power supply configured to supply cutting power to the ignitor.

Moreover, disclosed herein are methods of disconnecting a first tubular and a second tubular, which methods may each include: coupling a downhole tubular disconnect assembly between the first tubular and the second tubular, wherein the downhole tubular disconnect assembly comprises: a parting sub; a cutting charge coupled to an outer surface of the parting sub; an ignition coupled to the cutting charge; and a sleeve disposed over the cutting charge; deploying a dart in the parting sub; sending a signal from the deployed dart to the ignition assembly to ignite the cutting charge; and directing material from the ignited cutting charge against the outer surface of the parting sub.

Furthermore, disclosed herein are methods of disconnecting a first tubular and a second tubular, which methods may each include: providing a tubular sub-section having an axially elongated thin wall section between stepped bosses at opposite ends thereof, the thin wall section and bosses having an axial flow bore therethrough, the thin wall section having a base outer diameter that is less than a first outer diameter of a first tread on a first boss of the bosses, a second boss of the bosses having second tread on an axially opposite side of the first boss from the thin wall section, the second boss second tread having a second outer diameter that is greater than the base diameter, a third boss of the bosses having a third tread between the thin wall section and first step, the third tread having a third diameter less than the first diameter and greater than the base diameter; coaxially mounting an axially elongated sleeve having a first end and a second end, the first end having a first internal bore with a first inner diameter corresponding to a slip fit over the second tread on the bosses, the second end having a second internal bore with a second inner diameter corresponding to a slip fit over the third tread on the bosses; mounting one or more cutting charges on the periphery of the thin wall section, the one or more cutting charges capable of generating cutting jets directed towards the outer surface of the thin wall section in response to an ignition signal; transmitting the ignition signal to the one or more cutting charges; generating the cutting jets; and cutting the outer surface of the thin wall section when the cutting jets impact the outer surface of the thin wall section.

BRIEF DESCRIPTION OF THE DRAWINGS

FIG. 1D illustrates a cross-sectional view of a severed tubular decoupling assembly. FIG. 1E illustrates a cross-sectional view of an upper drill string section separated from a parting sub stub. FIG. 1F illustrates a profile view of a parting sub stub.

DETAILED DESCRIPTION

1. Introduction

Figures 1A, 1B, 1C, 1D, 1E, 1F:
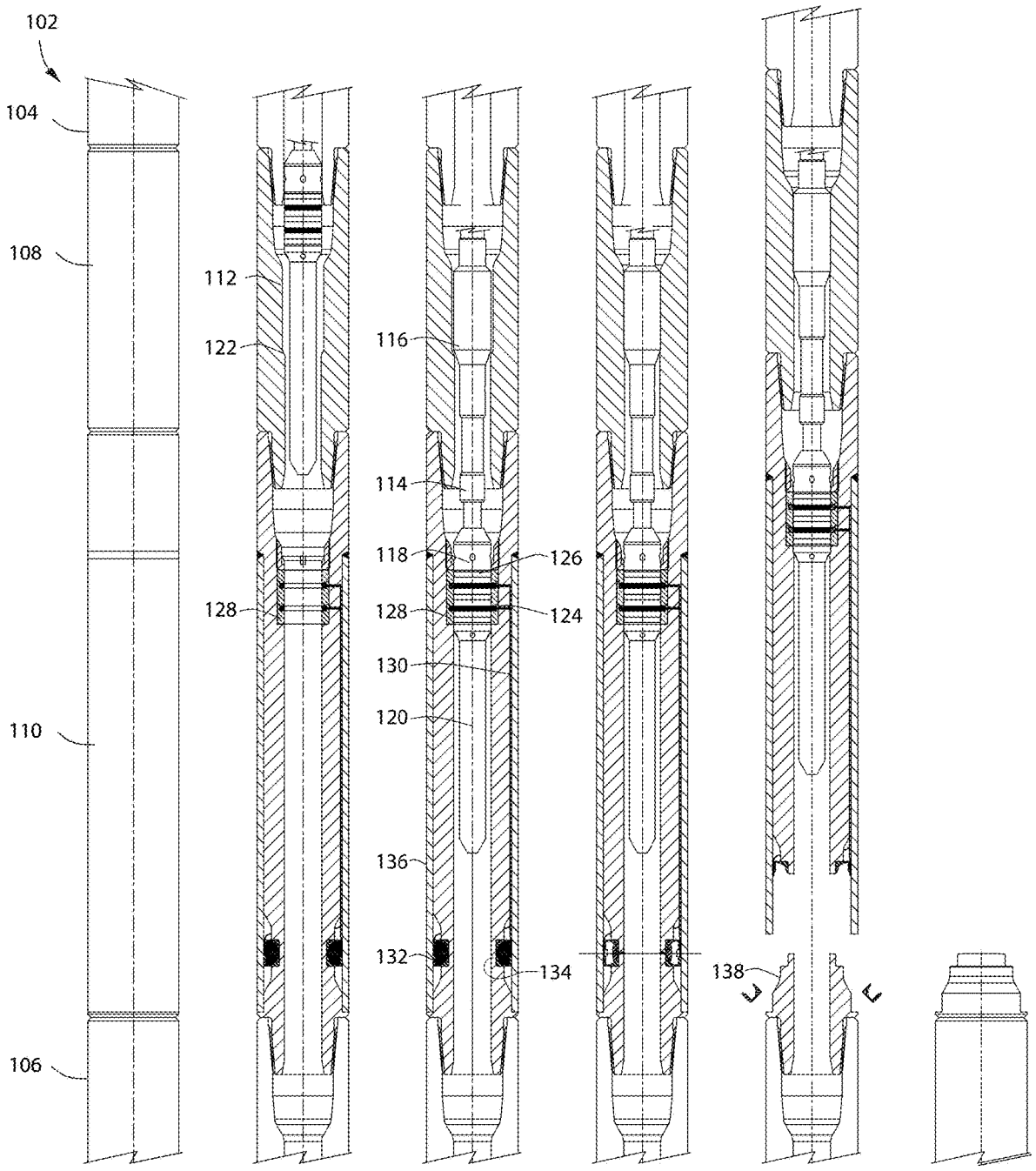
FIG. 1A illustrates a profile view of a portion of a drill string that includes downhole tubular disconnect assembly.
FIG. 1B illustrates cross-sectional view of a tubular disconnect assembly and an actuation assembly seated thereon.
FIG. 1C illustrates a cross-sectional view of a tubular disconnect assembly having a spent charge.
FIGS. 1D-F illustrate views of severed tubular decoupling assemblies.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "aligning" as used herein is a verb that means manufacturing, forming, adjusting, or arranging one or more physical objects into a particular position. After any aligning takes place, the objects may be fully or partially "aligned." Aligning preferably involves arranging a structure or surface of a structure in linear relation to another structure or surface; for example, such that their borders or perimeters may share a set of parallel tangential lines. In certain instances, the aligned borders or perimeters may share a similar profile. Additionally, apertures may be aligned, such that a structure or portion of a structure may be extended into and/or through the apertures.

The term "aperture" as used herein is defined as any opening in a solid object or structure, e.g., seating sub, parting sub, sleeve, or cap. For example, an aperture may be an opening that begins on one side of a solid object, e.g., seating sub, parting sub, sleeve, or cap, and ends on the other side of the object. An aperture may alternatively be an opening that does not pass entirely through an object, but only partially passes through, e.g., as a groove. An aperture can be an opening in an object, e.g., seating sub, parting sub, sleeve, or cap, that is completely circumscribed, defined, or delimited by the object itself. Alternatively, an aperture can be an opening in the object, e.g., seating sub, parting sub, sleeve, or cap, when the object is combined with one or more other objects or structures. An aperture may receive an object, e.g., seating sub, parting sub, cap, controller, or power pack, and permit ingress and/or egress of the object through the aperture. For example, a parting sub may be received in an aperture of a sleeve, a seating sub, or an cap.

The term "assembly" as used herein is defined as any set of components that have been fully or partially assembled together. A group of assemblies may be coupled form a solid body having an inner surface and an outer surface.

The term "cap" as used herein as a noun is defined as a structure capable of being removably coupled to a parting sub. A cap may have a threaded portion, e.g., pin threads or male threads, capable of being engaged with a threaded portion, e.g., box threads or female threads, of parting sub. A cap may have a collar that is radiused or tapered. A cap may have a collar that may be slidably abutted against a collar of a sleeve or a parting sub.

The term "charge" as used herein as a noun is defined as structure capable of having material, e.g., molten metal, oxide, compound, and/or reactant, discharged therefrom. A charge may include explosive material, e.g., RDX, PETN, TNT and HMX. A charge may include explosive materials, e.g., bromine trifluoride. A charge may include exothermic materials, e.g., thermite. A charge may include a compound disposed in a shell. A charge may include a shell having a cross-section of a block-letter "C." A charge may include a shell having an aperture through which material may be jetted through the aperture. Material may be jetted from an ignited charge to flay, corrode, and/or weaken the surface of an object, e.g. decoupling section of a parting sub. A charge may also be known as a cutting segment.

The term "coupled" as used herein is defined as directly or indirectly connected, attached, e.g., part of. A first object may be coupled to a second object such that the first object is positioned at a specific location and orientation with respect to the second object. For example, a sleeve may be coupled to wire gland assembly or cap. A first object may be either permanently, removably, threadably, and/or sealably coupled to a second object. Two objects may be removably coupled to each other via shear pins, electrical wires, threads, tape, latches, hooks, fasteners, locks, male and female connectors, clips, and/or clamps. For instance, a sleeve and a parting sub may be removably coupled to each other such that the sleeve may then be uncoupled and removed from the parting sub. In addition, a receiver may be coupled to an ignition head via electric wires such that electrical energy may be transmitted between the receiver and ignition head over the electrical wire. Also, two objects may be capable of being slidably coupled together, e.g., where an inner aperture of one object is capable of receiving a second object. Thus, seating sub, parting sub, sleeve, or cap having apertures disposed therethrough may receive a portion of a seating sub, parting sub, sleeve, or cap. Additionally, two objects may be capable of being threadably coupled, e.g., where a threaded outer surface of one object is capable of engaging with or to a threaded inner surface of another object. Threadably coupled objects may be removably coupled. Accordingly, a seating sub may be threadably coupled to a parting sub where a threaded inner surface, e.g., box threads or female threads, of the seating sub may be engaged with a threaded outer surface, e.g., pin threads or male threads, of the parting. Also, a parting may be threadably coupled to a cap where a threaded inner surface, e.g., box threads or female threads, of the cap may be engaged with a threaded outer surface, e.g., pin threads or male threads, of the parting sub. Moreover, two objects may be capable of being sealably coupled, e.g., where portions of the surfaces of the objects are capable of being abutted against each other so as to inhibit passage of fluid, gas, and/or particles between the portions of the surfaces. For example, a collar of a cap may be pressed and/or abutted against a collar of a sleeve and a collar of a parting such that the collars of cap, sleeve, and parting may form a seal. Alternatively, seal ring may be disposed between surfaces of objects, e.g., a seating sub, parting sub, sleeve, or cap, that are pressed and/or abutted against each other. The seal ring may be constructed from an elastic material, e.g., elastomer, plastic, latex, rubber, nitrile rubber, butyl rubber, silicone, neoprene, and/or polyvinyl chloride, The term "cylindrical" as used herein is defined as shaped as a cylinder, e.g., having straight parallel sides and a circular or oval or elliptical cross-section. A cylindrical body or structure, e.g., drill pipe, sleeve, parting sub, seating sub, cap, trigger assembly, or actuation assembly, may be completely or partially shaped like a cylinder. A cylindrical body, e.g., drill pipe, seating sub, parting sub, sleeve, cap, trigger assembly, or actuation assembly, that has an inner or outer diameter that changes abruptly may have a radial face, collar, shoulder, or lip (see, e.g., 206, 208, FIG. 2 and FIG. 4) extending toward the center axis. Additionally, a cylindrical body, e.g., drill pipe, sleeve, parting sub, seating sub, or cap, may have a lip that is tapered or radiused. A cylindrical body may have an aperture that is extended through the entire length of the body to form a hollow cylinder that is capable of permitting another body, e.g., drill pipe, sleeve, parting sub, seating sub, cap, trigger assembly, or actuation assembly, to be extended or passed through.

The terms "first" and "second" as used herein merely differentiate two or more things or actions, and do not signify anything else, including order of importance, sequence, etc.

The term "ignition assembly" as used herein defined as a structure for delivering igniting energy, e.g. to ignite a cutting charge. An ignition assembly may include electrical wires and one or more ignition heads. An ignition assembly may include electrical wires, a process controller, one or more power packs, and one or more ignition heads.

The term "parting sub" as used herein is defined as a structure capable of being removably coupled to a sleeve and/or a cap. A parting sub may have pin threads, e.g., male threads, capable of being engaged with box threads, e.g., female threads, of a sleeve and/or a cap. A parting sub may have box threads, e.g., female threads, capable of being engaged with pin threads, e.g., male threads, of a sleeve. A parting sub may have an aperture disposed therethrough, which aperture is capable is capable of having a portion of an electrical wire, e.g., terminal, extended therethrough. A parting sub may have grooves disposed therein. A parting sub may have grooves disposed axially to the length of the parting sub. A parting sub may have grooves disposed parallel with a central axis of the parting sub. A parting sub may have grooves for receiving a controller and/or a power pack.

The term "perpendicular" as used herein is defined as at an angle of substantially 90°, e.g., to a line, a plane, or a surface.

The term "power pack" as used herein defined as a structure capable of emitting electrical energy. A power pack may be one or more batteries.

The term "providing" as used herein is defined as making available, furnishing, supplying, equipping, or causing to be placed in position.

The term "receiver" as used herein defined as a device for receiving electrical energy and/or electromagnetic waves, e.g., signals. A receiver may transfer electric, e.g., to a process controller or an ignition assembly. A transmitter may include an antenna. A transmitter may include an inductive coil.

The term "seal ring" as used herein is defined as a structure capable of being sealably coupled to objects, e.g., drill pipe, a seating sub, parting sub, sleeve, or cap, that are pressed and/or abutted against each other. A seal ring may be constructed from an elastic material, e.g., elastomer, plastic, latex, rubber, nitrile rubber, butyl rubber, silicone, neoprene, and/or polyvinyl chloride. A seal ring may be resiliently deformed.

The term "sleeve" as used herein is defined as a structure capable of being slidably coupled to an object, e.g., parting sub. A sleeve may be cylindrical. A sleeve may cover an object, e.g., parting sub or cutting charge, or components, e.g., parting section or socket surfaces of an object, e.g., parting sub. A sleeve may have a castellated collar. A sleeve may have a castellated collar capable of being coupled to a castellated collar of a parting sub. A sleeve may have a socket. A sleeve may have a socket capable of being coupled to a socket surfaces of a parting sub.

The term "socket surfaces" as used herein defined as connected surfaces having a polygonal, e.g., triangular, square, rectangular, pentagonal, hexagonal, or octagonal, cross-section. Socket surfaces may have planar walls connected to form a polygonal, e.g., triangular, square, rectangular, pentagonal, hexagonal, or octagonal, shape. Males socket surfaces may be disposed on an outer surface of a cylindrical structure, e.g., sleeve, parting sub, cap, rod, or bolt. Female socket surfaces may be disposed on an inner surface of a cylindrical structure, e.g., sleeve, parting sub, cap, rod, or bolt. Male socket surfaces may be coupled to a female socket surfaces of a wrench, e.g., socket wrench and/or a crescent wrench.

The term "surface" as used herein is defined as any face of a structure. A surface may also refer to that flat or substantially flat area that is extended radially around a cylinder which may, for example, be part of a shaft assembly or bearing assembly. A surface may also refer to that flat or substantially flat area that extend radially around a cylinder which may, for example, be part of a sleeve, parting sub, seating sub, or cap. A surface may have irregular contours. A surface may be formed from components, e.g. sleeve, parting sub, seating sub, or cap, seal, transmitter, receiver, and/or cap, coupled together. Coupled components may form irregular surfaces.

The term "thermite" as used herein refers to a combustible mixture, e.g., aluminum and ferric oxide. Thermite may be packed into a shell. When ignited, thermite may undergo an exothermic reduction-oxidation reaction. Ignited thermite may discharge bursts of high temperature. Ignited thermite may discharge heat greater than 2500 degrees Celsius. Ignited thermite may discharge jets of molten material. Thermite may include fuel, e.g., aluminum, magnesium, titanium, zinc, silicon, and boron. Thermites may include oxidizers, e.g., include bismuth oxide, boron oxide, silicon oxide chromium oxide, manganese oxide, iron oxide, copper oxide, and lead oxide. Thermites with nanosized particles may be described as "super thermites".

The term "threaded" as used herein is defined as having threads. Threads may include one or more helical protrusions or grooves on a surface of a cylindrical object. Each full rotation of a protrusion or groove around a threaded surface of the object is referred to herein as a single "thread." Threads formed on an inner surface of an object, e.g., drill pipe, sleeve, parting sub, seating sub, cap, trigger assembly, or actuation assembly, may be referred to as box threads or female threads. Threads formed on an outer surface of an object, e.g., drill pipe sleeve, parting sub, seating sub, cap, trigger assembly, or actuation assembly, may be referred to as pin threads or male threads. A threaded assembly may include a "threaded portion" wherein a section of the threaded assembly includes threads, e.g., pin threads or box threads. A threaded portion may have a diameter sized to extend through an aperture of a module coupler body. In certain cases, a threaded portion of a structure may be removably coupled to a threaded assembly.

The term "transmitter" as used herein defined as an electronic device capable transmitting electrical energy and/or electromagnetic waves, e.g., signals. A transmitter may include an antenna. A transmitter may include an inductive coil.

The term "tubular" as used herein is defined any structure having an inner surface and an outer surface. A tubular may have an aperture disposed therethrough. Preferably, a tubular is cylindrical. However, any or all tubulars of an assembly, e.g., drill pipe, sleeve, parting sub, seating sub, cap, trigger assembly, or actuation assembly, may have polygonal cross-sections, e.g., triangular, rectangular, pentagonal, hexagonal, or octagonal.

The term "unitary" as used herein defined as having the nature, properties, or characteristics of a single unit. For example, a collar, a decoupling portion, and a pin that are individual parts of a parting sub may be unitary in the sense they are not separate but rather are formed from a single piece of material, e.g. plastic, carbon fiber, metal, or wood.

The terms "upper," "lower," "top," "bottom" as used herein are relative terms describing the position of one object, thing, or point positioned in its intended useful position, relative to some other object, thing, or point also positioned in its intended useful position, when the objects, things, or points are compared to distance from the center of the earth. The term "upper" identifies any object or part of a particular object that is farther away from the center of the earth than some other object or part of that particular object, when the objects are positioned in their intended useful positions. The term "lower" identifies any object or part of a particular object that is closer to the center of the earth than some other object or part of that particular object, when the objects are positioned in their intended useful positions. For example, a wellbore may have an upper end and a lower end. Additionally, a cylindrical object, e.g., sleeve, parting sub, seating sub, or cap, may have an upper portion and a lower portion. The term "top" as used herein means in the highest position, e.g., farthest from the ground. The term "bottom" as used herein means in the lowest position, e.g., closest the ground. For example, a cylindrical object, e.g., sleeve, parting sub, seating sub, or cap, may have a top portion and a bottom portion.

The term "wall" as used herein is defined as any structure having a planar surface. A wall may have curved planar sides that may or may not be parallel to one another. For example, a cylindrical wall may be a curved wall whose cross-section resembles a letter "O," as exemplified by some of the sleeve, parting sub, seating sub, or cap disclosed herein. A wall may have planar sides that may or may not be parallel to one another. For example, a socket surfaces may be connected walls whose cross-section resembles a polygon, e.g., triangle, square, rectangle, pentagon, hexagon, or octagon.

3. Certain Specific Embodiments

Disclosed herein are downhole tubular disconnect assemblies, which downhole tubular disconnect assemblies may each include: a parting sub having a decoupling portion; a cutting charge coupled to an outer surface of the decoupling portion; an ignition assembly coupled to the parting sub and the cutting charge; a sleeve disposed over the decoupling portion of the parting sub and the cutting charge; and an end cap coupled to the parting sub and abutted against the sleeve.

Additionally, disclosed herein are downhole tubular disconnect assemblies, which downhole tubular disconnect assemblies may each include: a parting sub having a decoupling portion and a groove; a cutting charge coupled to an outer surface of the decoupling portion; an ignition assembly coupled to the parting sub and the cutting charge, the ignition assembly comprising: a receiver coupled to an inner surface of the parting sub; a controller disposed in the groove of the parting sub and coupled to the receiver; a power pack disposed in the groove of the parting sub; an ignition head capable of igniting the cutting charge; and a sleeve covering the decoupling portion of the parting sub and the cutting charge; and an end cap coupled to the parting sub and abutted against the sleeve.

Also, disclosed herein are downhole tubular disconnect assemblies, which downhole tubular disconnect assemblies may each include: a tubular sub-section having an axially elongated thin wall section between stepped bosses at opposite ends thereof, the thin wall section and bosses having an axial flow bore therethrough, a first tread on a first boss of the bosses having a first diameter, a second boss of the bosses having second tread on an axially opposite side of the first boss from the thin wall section, the second boss second tread having a second outer diameter that is less than the first diameter, a third boss of the bosses having a third tread between the thin wall section and first step, the third tread having a third diameter less than the first diameter, the thin wall section having a base outer diameter that is less than the second and third outer diameters; an axially elongated sleeve having a first end and a second end, the first end having a first internal bore with a first inner diameter corresponding to a slip fit over the second tread on the bosses, the second end having a second internal bore with a second inner diameter corresponding to a slip fit over the third tread on the bosses; one or more cutting charges mounted on the periphery of the thin wall section; an ignitor configured to ignite and burn the one or more cutting charges, the burning of the one or more cutting charges generates cutting jets directed towards the outer surface of the thin wall section; and a power supply configured to supply cutting power to the ignitor.

Moreover, disclosed herein are methods of disconnecting a first tubular and a second tubular, which methods may each include: coupling a downhole tubular disconnect assembly between the first tubular and the second tubular, wherein the downhole tubular disconnect assembly comprises: a parting sub; a cutting charge coupled to an outer surface of the parting sub; an ignition coupled to the cutting charge; and a sleeve disposed over the cutting charge; deploying a dart in the parting sub; sending a signal from the deployed dart to the ignition assembly to ignite the cutting charge; and directing material from the ignited cutting charge against the outer surface of the parting sub.

Furthermore, disclosed herein are methods of disconnecting a first tubular and a second tubular, which methods may each include: providing a tubular sub-section having an axially elongated thin wall section between stepped bosses at opposite ends thereof, the thin wall section and bosses having an axial flow bore therethrough, the thin wall section having a base outer diameter that is less than a first outer diameter of a first tread on a first boss of the bosses, a second boss of the bosses having second tread on an axially opposite side of the first boss from the thin wall section, the second boss second tread having a second outer diameter that is greater than the base diameter, a third boss of the bosses having a third tread between the thin wall section and first step, the third tread having a third diameter less than the first diameter and greater than the base diameter; coaxially mounting an axially elongated sleeve having a first end and a second end, the first end having a first internal bore with a first inner diameter corresponding to a slip fit over the second tread on the bosses, the second end having a second internal bore with a second inner diameter corresponding to a slip fit over the third tread on the bosses; mounting one or more cutting charges on the periphery of the thin wall section, the one or more segments capable of generating cutting jets directed towards the outer surface of the thin wall section in response to an ignition signal; transmitting the ignition signal to the one or more cutting charges; generating the cutting jets; and cutting the outer surface of the thin wall section when the cutting jets impact the outer surface of the thin wall section.

In any one of the methods or structures disclosed herein, the second and third bosses may have a plurality of wrench flats formed about the tread perimeter thereof; a first end of the sleeve may have a first inside collar around an aperture with one or more internal wrench flats for meshing with the second boss; and a second end of the sleeve may have a second inside collar around an aperture with one or more internal wrench flats for meshing with the third boss.

In any one of the methods or structures disclosed herein, the second and third bosses may have a plurality of wrench flats formed about the tread perimeter thereof; a first end of the sleeve may have a first inside collar around an aperture with one or more internal wrench flats for meshing with the second boss; a second end of the sleeve may have a second inside collar around an aperture with one or more internal wrench flats for meshing with the third boss; a riser face of the first boss between the first tread and third tread may be formed to follow a castellation perimeter; and the second end of the sleeve may be formed with a castellation perimeter to mesh with the riser face perimeter.

In any one of the methods or structures disclosed herein, the second and third bosses may have a plurality of wrench flats formed about the tread perimeter thereof; a first end of the sleeve may have a first inside collar around an aperture with one or more internal wrench flats for meshing with the second boss; and a second end of the sleeve may have a second inside collar around an aperture with one or more internal wrench flats for meshing with the third boss.

In any one of the methods or structures disclosed herein, the second and third bosses may have a plurality of wrench flats formed about the tread perimeter thereof; a first end of the sleeve may have a first inside collar around an aperture with one or more internal wrench flats for meshing with the second boss; a second end of the sleeve may have a second inside collar around an aperture with one or more internal wrench flats for meshing with the third boss; a riser face of the first boss between the first tread and third tread may be formed to follow a castellation perimeter; and the second end of the sleeve may be formed with a castellation perimeter to mesh with the riser face perimeter.

In any one of the methods or structures disclosed herein, a riser face of the first boss between the first tread and third tread may be formed to follow a castellation perimeter; a second end of the sleeve may be formed with a castellation perimeter to mesh with the riser face perimeter; the second boss may have a plurality of wrench flats formed about the tread perimeter thereof; and the second end of the sleeve may have a second inside collar around an aperture with one or more internal wrench flats for meshing with the third boss.

In any one of the methods or structures disclosed herein, each cutting segment may include thermite material.

In any one of the methods or structures disclosed herein, each cutting segment may include explosive material.

In any one of the methods or structures disclosed herein, each cutting segment may include corrosive material.

In any one of the methods or structures disclosed herein, each cutting segment may further include a cut resistant shell, the cut resistant shell having a port in communication with the downhole tubular.

Any one of the methods or structures disclosed herein may further include a plug seat aperture configured to mate with the power supply and when mated, to cause the power supply to supply cutting power to the ignitor.

In any one of the methods or structures disclosed herein, the power supply may be configured to receive a signal and when the signal is received, to supply cutting power to the ignitor.

In any one of the methods or structures disclosed herein, a riser face of the first boss between the first tread and third tread may be formed to follow a castellation perimeter; a second end of the sleeve may be formed with a castellation perimeter to mesh with the riser face perimeter; the second boss may have a plurality of wrench flats formed about the tread perimeter thereof; and the second end of the sleeve may have a second inside collar around an aperture with one or more internal wrench flats for meshing with the third boss.

In any one of the methods or structures disclosed herein, each cutting segment may include thermite material.

In any one of the methods or structures disclosed herein, each cutting segment may include explosive material.

In any one of the methods or structures disclosed herein, each cutting segment may include corrosive material.

In any one of the methods or structures disclosed herein, each cutting segment may further include a cut resistant shell, the cut resistant shell may have a port in communication with the downhole tubular.

Any one of the methods or structures disclosed herein may further include a plug seat aperture that may be mated with the power supply and when mated, to cause the power supply to supply cutting power to the ignitor.

In any one of the methods or structures disclosed herein, the power supply may be configured to receive a signal and when the signal is received, to supply cutting power to the ignitor.

In any one of the methods or structures disclosed herein, when the cutting charge is ignited, material from the cutting charge may be directed towards the outer surface of the decoupling portion.

In any one of the methods or structures disclosed herein, when the cutting charge is ignited, material from the cutting charge may be directed towards a central axis of the parting sub.

In any one of the methods or structures disclosed herein, an upper portion of the parting sub may be coupled to the first downhole tubular and a lower portion of the end cap may be coupled to the second downhole tubular.

In any one of the methods or structures disclosed herein, the parting sub, sleeve, and end cap may be coaxial.

In any one of the methods or structures disclosed herein, the parting sub may further include a shoulder that is abutted against the sleeve.

In any one of the methods or structures disclosed herein, the parting sub further may be coupled to a first portion of a downhole tubular.

In any one of the methods or structures disclosed herein, the parting sub may further include a seat capable of seating an actuator assembly.

In any one of the methods or structures disclosed herein, the parting sub may further include a seat disposed above the decoupling portion.

In any one of the methods or structures disclosed herein, a seating sub may be coupled to the parting sub.

Any one of the methods or structures disclosed herein may further a seating sub coupled to an upper portion of the parting sub.

Any one of the methods or structures disclosed herein may further include a seating sub capable of seating an actuator assembly.

Any one of the methods or structures disclosed herein may further include an actuator assembly capable of transferring igniting power to the ignition assembly.

Any one of the methods or structures disclosed herein may further include an actuator assembly that includes: a power pack; a controller coupled to the power pack and capable of receiving igniting power from the power pack, a transmitter coupled to the controller and capable of transmitting igniting power; and a switch coupled to the controller.

In any one of the methods or structures disclosed herein, the parting sub may further include: a first socket head; and a second socket head; and the sleeve may further include: a first socket slidably coupled to the first socket head of the parting sub; and a second socket slidably coupled to the second socket head of the parting sub.

In any one of the methods or structures disclosed herein, the parting sub may further include: a castellated lip; and a socket head; and the sleeve may further include: a castellated lip slidably coupled to the castellated lip of the parting sub; and a socket slidably coupled to the socket head of the parting sub.

In any one of the methods or structures disclosed herein, the ignition assembly may further include: a receiver coupled to an inner surface of the parting sub; an ignition head capable of igniting the cutting charge; and an electrical wire coupled to the receiver and the ignition head.

In any one of the methods or structures disclosed herein, the ignition assembly may further include: a receiver coupled to an inner surface coupled to the parting sub above the cutting charge, wherein the receiver is capable of receiving power; an ignition head capable of transferring power to the cutting charge; and an electrical wire capable of transferring power from the receiving to the ignition head.

In any one of the methods or structures disclosed herein, the ignition assembly may further include a receiver coupled to an inner surface coupled to the parting sub above the cutting charge, wherein the receiver may be capable of receiving power from an actuator assembly without physical contact with actuator assembly.

In any one of the methods or structures disclosed herein, the cutting charge may further include: a shell disposed in the decoupling portion of the parting sub, wherein the sleeve may have a groove facing an outer surface of the decoupling portion; and the thermite may be disposed in the groove of the sleeve.

In any one of the methods or structures disclosed herein, the cutting charge may include: a sleeve disposed in the decoupling portion of the parting sub, wherein the sleeve may have a groove having a tapered end facing an outer surface of the decoupling portion; and the thermite may be disposed in the groove of the sleeve.

In any one of the methods or structures disclosed herein, the sleeve may cover the decoupling portion of the parting sub, the cutting charge, and the power pack.

In any one of the methods or structures disclosed herein, the controller of the power supply may be capable of receiving a signal from a receiver of the power supply assembly.

In any one of the methods or structures disclosed herein, the controller of the power supply may be capable of receiving igniting power from the power pack of power supply assembly.

In any one of the methods or structures disclosed herein, the controller of the power supply may be capable of transmitting igniting power to the ignition head of the power supply assembly.

Any one of the methods or structures disclosed herein may further include an actuator assembly capable of transmitting an ignition signal.

Any one of the methods or structures disclosed herein may further include an actuator assembly capable being passed through the parting sub and the end cap.

Any one of the methods or structures disclosed herein may further include an actuator assembly that may include: a power pack; a controller coupled to the power pack and capable of receiving power from the power pack, a transmitter coupled to the controller and capable of transmitting an ignition signal; and a switch coupled to the controller.

Any one of the methods or structures disclosed herein may further include an actuator assembly that may include: a power supply having a transmitter, a controller; a power pack; and a switch coupled to the controller.

Any one of the methods disclosed herein may further include cutting the parting sub with material from the ignited cutting charge.

Any one of the methods disclosed herein may further include eroding the parting sub with material from the ignited cutting charge.

Any one of the methods disclosed herein may further include corroding the parting sub with material from the ignited cutting charge.

4. Specific Embodiments in the Drawings

The drawings presented herein are for illustrative purposes only and do not limit the scope of the disclosure. Rather, the drawings are intended to help enable one having ordinary skill in the art to make and use the assemblies disclosed herein.

This section addresses specific versions of downhole tubular disconnect assemblies and methods for disconnect portions of a drill string and elements and parts that can be part of a downhole tubular disconnect assembly. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

FIGS. 1A-D illustrate views of a drill string including a tubular disconnect assembly 110 at different severing stages.

FIG. 1A illustrates a profile view of a portion of a drill string 102. The drill string 102 may include an upper drill pipe 104, lower drill pipe 106, and a tubular disconnect assembly 110. The upper drill pipe 104 may be coupled to an upper end of the tubular disconnect assembly 110. The tubular disconnect assembly 110 may have a lower end coupled to the lower drill pipe 106. The upper drill pipe 104, the lower drill pipe 106, and the tubular disconnect assembly 110 may a share a central axis.

FIG. 1B is a cross-sectional view of the drill string 102 of FIG. 1A having a dart assembly 114 disposed therein. The dart assembly 114 may include a trigger assembly 116 and an actuation assembly 118. The actuation assembly 118 may include a housing 120 to house one or more power packs (not shown) and a process controller (not shown). Additionally, the actuation assembly 118 may include a transmitter 126 disposed on an outer surface of the housing 120. The trigger assembly 116 may include a shoulder 146 that can be seated on a seat 122 of the seating sub 108 of a tubular disconnect assembly 110.

The tubular disconnect assembly 110 may include the seating sub 108, a parting sub 200, an ignition assembly 124, a sleeve 136, and an end cap 202. The parting sub 200 may include a disconnect portion 134 and an upper collar 206*a*. The sleeve 136 may be slidably coupled to the parting sub 200. From the lower end of the parting sub 200, the sleeve 136 may be slid towards the upper collar 206*a* of the parting sub 200. The upper end of the sleeve may be abutted against the upper collar 206*a*. Additionally, a pin of the parting sub 200 may be extended through the lower end of the sleeve 136.

The pin of the parting sub 200 may having pin threads. As shown in FIG. 1B, the end cap 202 may have a box having box threads coupled to the pin threads of parting sub 200. Additionally, the end cap 202 may have a lip 144 that may be abutted against the lower end of the sleeve 136 and a lower shoulder 146 of the parting sub 200. Abutment of the lip 144 against the sleeve 136 may cause the upper end of the sleeve 136 to remain abutted against the upper collar 206*a* of the parting sub 200.

The ignition assembly 124 may include a receiver 128, an electrical wire 130, a charge 132. The receiver 128 may be coupled to the inner surface of the parting sub 200. The receiver 128 may be in physical contact with one or more transmitters 126 of the actuation assembly 118. In various versions, the receiver 128 may, in some cases, not be in physical contact with the receivers of the actuation assembly 114. However, the receiver 128 may still receive energy and/or signals from the transmitter 126 via induction or radio waves.

FIG. 1C is a cross-sectional view of a tubular disconnect assembly having a spent charge 132. During operation, igniting energy from the actuation assembly 114 to may be transmitted (via the ignition assembly 124) to ignite the charge 132 to cause a chemical reaction in the charge 132. The chemical reaction may cause jets, e.g., molten metal jets, high velocity plasma jets, or corrosive jets, to be jetted against the disconnect portion 134 of the parting sub 200. The jets may have high temperature and/or high velocity to case the surface of the disconnect portion 134 of the parting sub 200 to flay, corrode, and/or weaken.

As shown in FIG. 1D, during operation, the weakened disconnect portion 134 may be severed when an operator imparts pull and/or twisting force (from surface) upon the upper drill pipe 104. The disconnect portion 134 may be severed into an upper drill pipe section and a low drill pipe section at the area having received the jets from the charge 132. Afterwards, the operator may retrieve the upper drill pipe section and leave the lower drill pipe section for later operations.

Figure 2A:
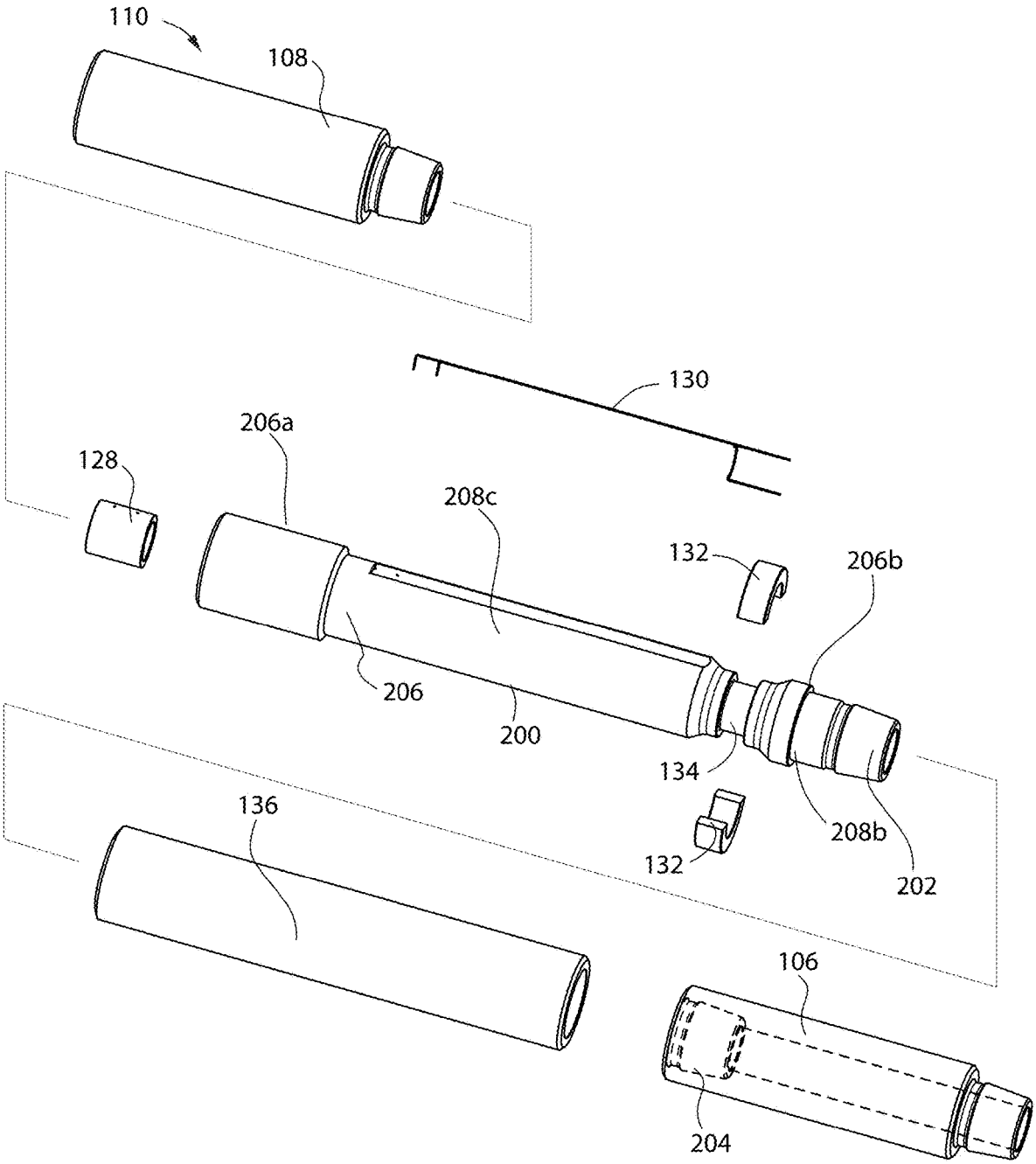
FIG. 2A illustrates an exploded view of a cross-sectional view of a tubular disconnect assembly.

FIG. 2A is an exploded view of a tubular disconnect assembly 110. The tubular disconnect assembly 110 may include a seating sub 108, a parting sub 200, a receiver 128, electrical wires 210, sleeve 136, charges 132, and an end cap 106. Referring to FIGS. 1A-D and FIG. 2A, the components may be assembled as follow. The seating sub 108 may be cylindrical tubular having a pin 218. The pin 218 may be abutted against a receiver 128. The receiver 128 may be slid into parting sub 200. Additionally, the parting sub 200, may have a seat (not shown) upon which the receive 128 may be seated. The pin 218 of the seating sub 136 may have pin threads for coupling to box threads in the box (not shown) of the parting sub 200. Thus, when the seating sub 108 is couple to the parting sub 200, the pin 218 of the seating sub 108 may be abutted against the receiver 128. Consequently, the receiver 128 may also remain abutted to the seat of the parting sub 200. The receiver 128 may be coupled to electrical wires 210. The electrical wires may be coupled to or embedded in the charges 132. The charges may be disposed in a disconnect portion of the parting sub 200.

The sleeve 136 may be slidably coupled to the parting sub 200. From the lower end of the parting sub 200, the sleeve 136 may be slid over a portion of the parting sub 200 until an upper lip of the sleeve is abutted against the upper collar 206*a* of the parting sub 200. The sleeve 136 may cover the electrical wires 210 and the charges 132.

Additionally, a threaded pin 202 of the parting sub 200 may be extended through a lower end of the sleeve 136. The threaded pin 202 may be coupled to a threaded box 204 of the end cap 106. When the parting sub 200 and the end cap 106 are coupled, a lip of the box 204 may be abutted against a lower collar 206*b* of the parting sub 200 and the lower end of the sleeve 136.

Figure 2B:
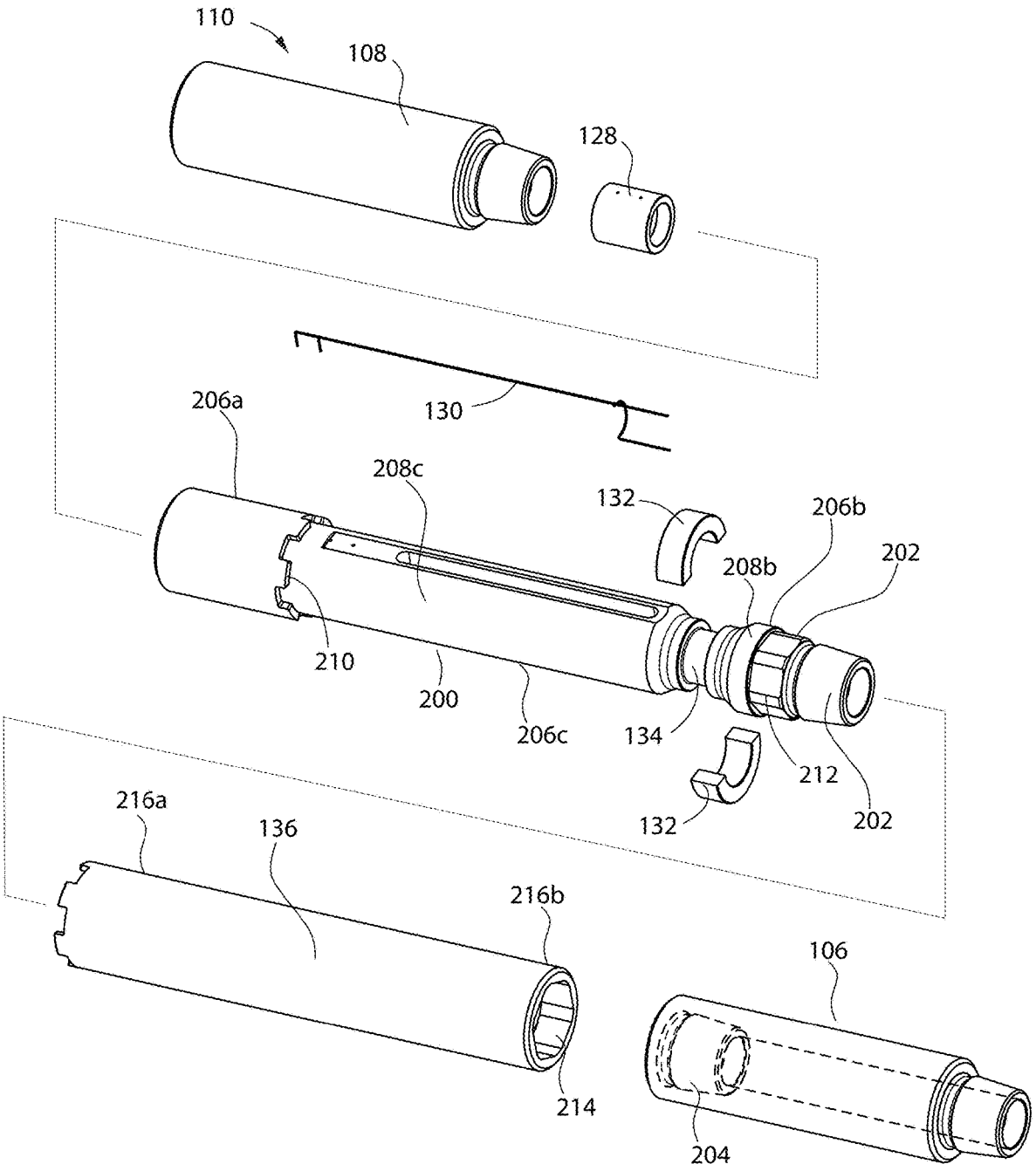
FIG. 2B illustrates an exploded view a tubular disconnect assembly having a parting sub having a castellated upper shoulder and a socket head.

FIG. 2B illustrates an exploded view a tubular disconnect assembly 110 having a parting sub having a castellated upper collar 206*a* and a socket head 218. The tubular disconnect assembly 110 may include a seating sub 108, a parting sub 200, a receiver 128, electrical wires 210, sleeve 136, charges 132, and an end cap 106. Referring to FIGS. 1A-D and FIG. 2B, the components may be assembled as follow. The seating sub 108 may be cylindrical tubular having a pin 218. The pin 218 may be abutted against a receiver 128. The receiver 128 may be slid into parting sub 200. Additionally, the parting sub 200, may have a seat (not shown) upon which the receive 128 may be seated. The pin 218 of the seating sub 136 may have pin threads for coupling to box threads in the box (not shown) of the parting sub 200. Thus, when the seating sub 108 is couple to the parting sub 200, the pin 218 of the seating sub 108 may be abutted against the receiver 128. Correspondingly, the receiver may also remain abutted to the seat of the parting sub 200. The receiver 128 may be coupled to electrical wires 210. The electrical wires may be coupled to or embedded in the charges 132. The charges may be disposed in a disconnect portion of the parting sub 200.

The sleeve 136 may be slidably coupled to the parting sub 200. From the lower end of the parting sub 200, the sleeve 136 may be slid over a portion of the parting sub 200 until a castellated collar 216*a* of the sleeve 136 is coupled to and/or abutted against the castellated upper collar 206*a* of the parting sub 200. In addition, the sleeve 136 may have a socket collar 216*b* having a socket 214 slidably coupled to the socket head 212. Also, the sleeve 136 may cover the electrical wires 210 and the charges 132.

During operation, torque may be applied from surface to the drill string to cause it to turn downhole. Accordingly, torque may be transferred to the castellated upper collar 206*a* of the parting sub 200. Since the castellated upper collar 206*a* may be coupled to the castellated collar 216*a* of the sleeve 136, torque may be transferred to the sleeve 136. Correspondingly, torque applied to the sleeve 136 may be transferred to the socket head 212 of the parting sub 200. Thus, the portion (including the disconnect portion 134) of the parting sub 200 covered by the sleeve 136 may receive less torque than applied to the castellated upper collar 206*a* and the socket head 212. In some cases, the portion (including the disconnect portion 134) of the parting sub 200 covered by the sleeve 136 may receive no torque.

Furthermore, a threaded pin 202 of the parting sub 200 may be extended through the socket collar 216*b* of the sleeve 136. The threaded pin 202 may be coupled to a threaded box 204 of the end cap 106. When the parting sub 200 and the end cap 106 are coupled, a lip of the box 204 may be abutted against a lower collar 206*b* of the parting sub 200 and the lower end of the sleeve 136.

Figure 2C:
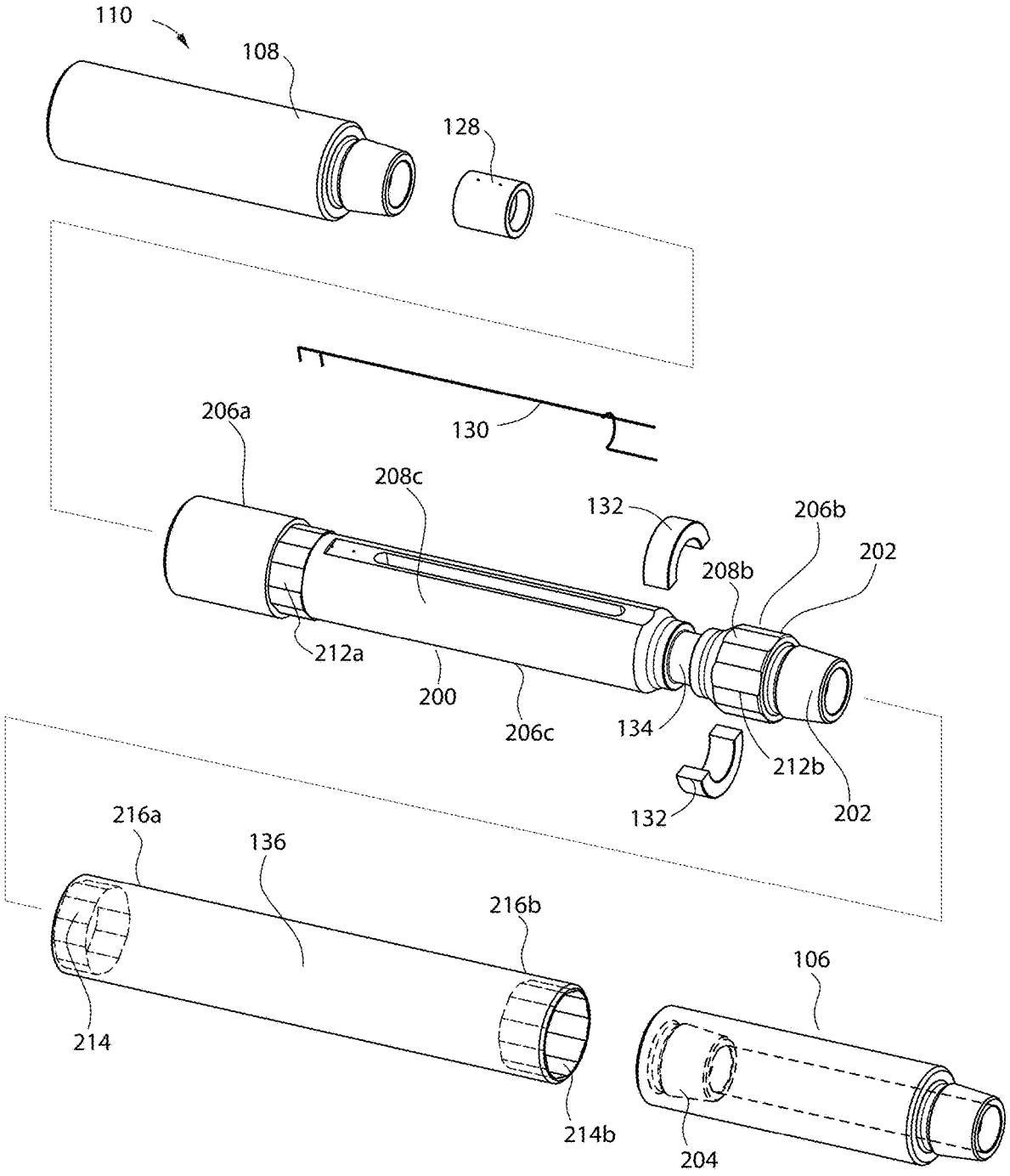
FIG. 2C illustrates an exploded view a tubular disconnect assembly having a parting sub having an upper socket head and a lower socket head.

FIG. 2C illustrates an exploded view a tubular disconnect assembly having a parting sub having an upper socket head and a lower socket head. The tubular disconnect assembly 110 may include a seating sub 108, a parting sub 200, a receiver 128, electrical wires 210, sleeve 136, charges 132, and an end cap 106. Referring to FIGS. 1A-D and FIG. 2B, the components may be assembled as follow. The seating sub 108 may be cylindrical tubular having a pin 218. The pin 218 may be abutted against a receiver 128. The receiver 128 may be slid into parting sub 200. Additionally, the parting sub 200, may have a seat (not shown) upon which the receive 128 may be seated. The pin 218 of the seating sub 136 may have pin threads for coupling to box threads in the box (not shown) of the parting sub 200. Thus, when the seating sub 108 is couple to the parting sub 200, the pin 218 of the seating sub 108 may be abutted against the receiver 128. Correspondingly, the receiver may also remain abutted to the seat of the parting sub 200. The receiver 128 may be coupled to electrical wires 210. The electrical wires may be coupled to initiator heads (not shown) embedded in the charges 132. The charges may be disposed in a disconnect portion of the parting sub 200.

The sleeve 136 may be slidably coupled to the parting sub 200. From the lower end of the parting sub 200, the sleeve 136 may be slid over a portion of the parting sub 200 until a collar 216*a* of the sleeve 136 is abutted against the upper collar 206*a* of the parting sub 200. The collar 216*a* of the sleeve 136 may have a socket 214*a*. The socket 214*a* may be slidably coupled to a socket head 214*a* of the parting sub 200. In addition, the sleeve 136 may have a collar 216*b* having a socket 214*b* slidably coupled to the socket head 212*b* of the parting sub 200. Also, the sleeve 136 may cover the electrical wires 210 and the charges 132.

During operation, torque may be applied from surface to the drill string to cause it to turn downhole. Accordingly, torque may be transferred to the upper collar 206*a* of the parting sub 200. Since the upper collar 206*a* may be coupled to the collar 216*a* of the sleeve 136 via the upper socket head 212*a* and socket 214*a*, respectively, torque may be transferred to the sleeve 136. Correspondingly, torque applied to the sleeve 136 may be transferred to the socket head 212*b* of the parting sub 200. Thus, the portion (including the disconnect portion 134) of the parting sub 200 covered by the sleeve 136 may receive less torque than applied to the castellated upper collar 206*a* and the socket head 212. In some cases, the portion (including the disconnect portion 134) of the parting sub 200 covered by the sleeve 136 may receive no torque.

Furthermore, a threaded pin 202 of the parting sub 200 may be extended through the socket collar 216*b* of the sleeve 136. The threaded pin 202 may be coupled to a threaded box 204 of the end cap 106. When the parting sub 200 and the end cap 106 are coupled, a lip of the box 204 may be abutted against a lower collar 206*b* of the parting sub 200 and the lower end of the sleeve 136.

Figure 3A:
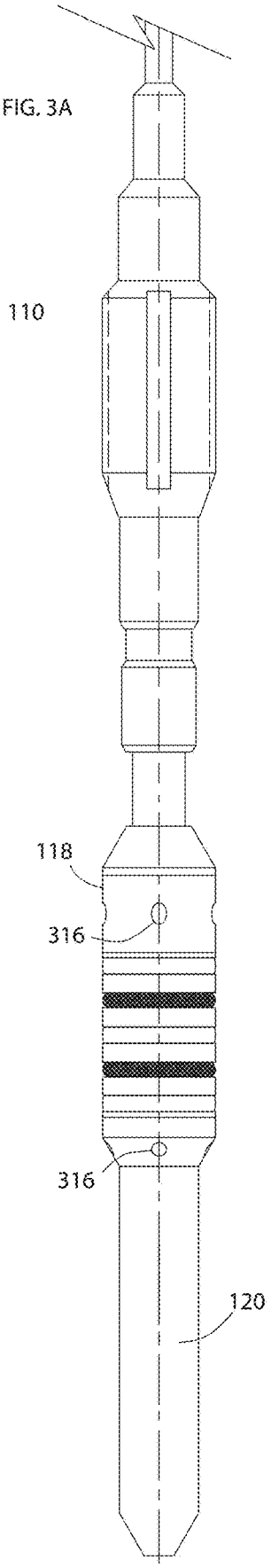
FIG. 3A illustrates a profile view of a dart assembly.

FIG. 3A illustrates a profile view of a dart assembly 114. The dart assembly 114 may include a trigger assembly 116 and an actuation assembly 118.

Figure 3B:
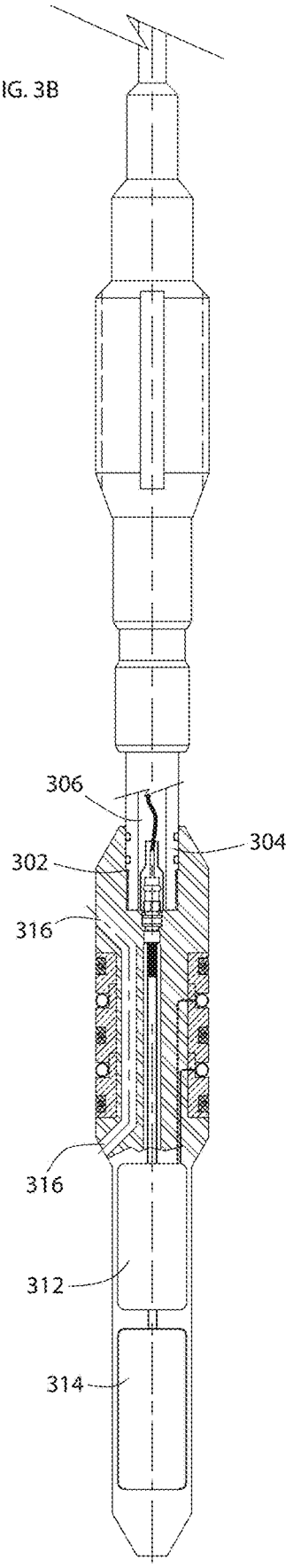
FIG. 3B illustrates a cross-sectional view of an actuation assembly of a dart assembly.

FIG. 3B illustrates a cross-sectional view of a dart assembly 114. The dart assembly 114 may include a trigger assembly 116 and an actuation assembly 118 coupled to each other. The trigger assembly 116 may have pin 302 having pin threads that is coupled to box 304 of the actuation assembly having box threads.

The actuation assembly 118 may include a housing 120, switch 310, a process controller 312, a power pack 314, and transmitter 126. The housing 120 may house the switch 310, the process controller 312 and the power pack 314. The transmitter 126 may be coupled to an outer surface of the housing 120. In addition, the housing 120 may include fluid ports 316 extended through a portion of the housing 120.

When the dart assembly 114 is deployed downhole, fluid within the drill string may inhibit descent of the dart assembly 114 downhole. The fluid ports 316 provide channels for the fluid to flow past the dart assembly 114. Thus, the descent of the dart assembly 114 may be less inhibited.

Returning to FIG. 3B, the switch 310 may be coupled to an electrical wire. The electrical wire may be part of a wireline extended downhole from surface. Additionally, the switch 310 may be coupled, e.g., via electrical wires, to the process controller 312. The process controller 312 may be coupled, e.g., via electrical wires, to the power pack 314. Also, the process controller may be coupled, e.g., via electrical wires, to the transmitter 126.

Figure 3C:
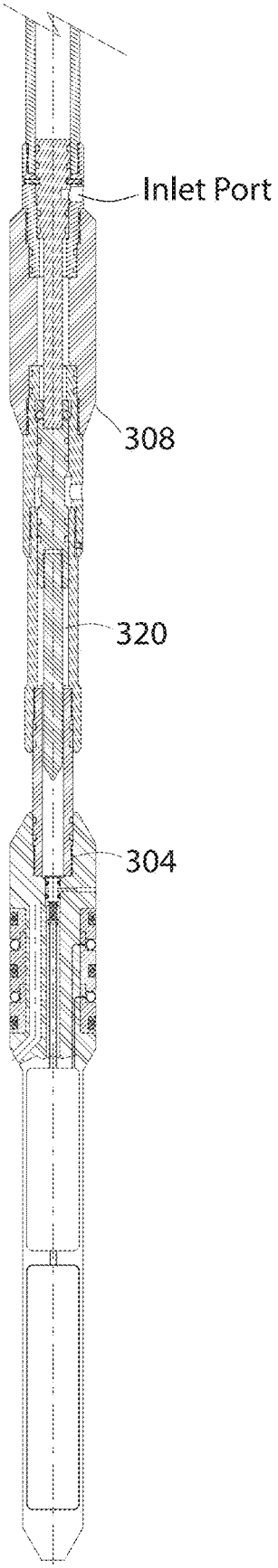
FIG. 3C illustrates a cross-sectional view of a dart assembly.

FIG. 3C illustrates a cross-sectional view of a dart assembly 114. The dart assembly 114 may include a trigger assembly 116 and an actuation assembly 118 coupled to each other. The trigger assembly 116 may have pin 302 having pin threads that is coupled to box 304 of the actuation assembly having box threads.

The trigger assembly 116 may include a housing and a piston 320 disposed in the housing. Additionally, the piston 320 may be retained in a deployment position via shear pins (not shown). The piston 320 may be sheared from the housing (during operation) to slide down the housing. The piston may be abutted against a switch 310 of the actuation assembly 118.

The actuation assembly 118 may include a housing 120, the switch 310, a process controller 312, a power pack 314, and transmitter 126. The housing 120 may house the switch 310, the process controller 312 and the power pack 314. The transmitter 126 may be coupled to an outer surface of the housing 120. In addition, the housing 120 may include fluid ports 316 extended through a portion of the housing 120.

During operations requiring severance of the drill string 102, an operator may deploy a dart assembly 114, e.g., via wireline, down the stuck drill string 102. Referring to FIGS. 1B-C and FIG. 3B-C, the dart assembly 114 may descend downhole by pump pressure or in free-fall. Once a trigger assembly 116 of the dart assembly 114 lands on a seating sub 108, a transmitter 126 of an actuation assembly of the dart assembly 114 may be aligned with a receiver 128 of an ignition assembly 124 disposed on a parting sub 200. Additionally, the transmitter 126 and the receiver 128 may be in physical contact with each other to provide for electrical conductance there between.

Once the operator receives an indication, e.g., via a pressure increase in the drill string, that the dart assembly 114 has landed on the seating sub 108, the operator may send a signal down a wireline to actuate the switch 310.

Alternatively, for a dart assembly 114 having a slidable piston 320, the operator may increase downward fluid pressure in the drill string against the piston 320. At a threshold pressure, the piston 320 may be sheared from the housing of the trigger assembly 116. The sheared piston 320 may be slid down the housing of the trigger assembly 116 until it is abutted against a switch 310. Furthermore, the piston 320 may be slid away from fluid ports 322 (FIG. 3C) of the housing of the trigger assembly 116. Fluid may exit the fluid ports 322 providing indication, e.g., via a pressure drop in the drill string, to the operator to pull on and apply torque to the drill string.

Next, the actuated switch 310 may activate the process controller 312. The process controller 312 may step through an ignition protocol. Among other conditions, the ignition protocol may require acknowledgement that the switch 310 has been actuated. Another condition may be that the transmitter 126 and receiver 128 are in electrical communication through a feedback loop. If the protocol is satisfied, the process controller 312 may complete a circuit through which electrical power from power pack 314 may be transmitted, e.g., electric wires, to the transmitter 126. The electrical energy may be transmitted from transmitter 126 to the receiver 128 of the ignition assembly 124. Additionally, the electrical energy may be transmitted from the receiver 128, e.g., via electrical wires, to initiator heads (not shown) embedded in the charges 132 disposed on a disconnect portion 134 of a parting sub 200. The initiator heads may ignite the charges 132 to cut the disconnect portion 134. Preferably, the initiator heads ignite the charges 132 simultaneously at multiple radial locations around the disconnect portion 134.

In some cases, the charges 132 may cut completely through the disconnect portion 134, thereby severing the drill string 102 into an upper drill string portion and lower drill string portion. In other cases, the charges 132 may not cut completely through the disconnect portion 134. However, the pull force and torque applied to the drill string may cause the disconnect portion 134 to break and/or tear, thereby also severing the drill string 102 into an upper drill string portion and lower drill string portion.

Figure 4A:
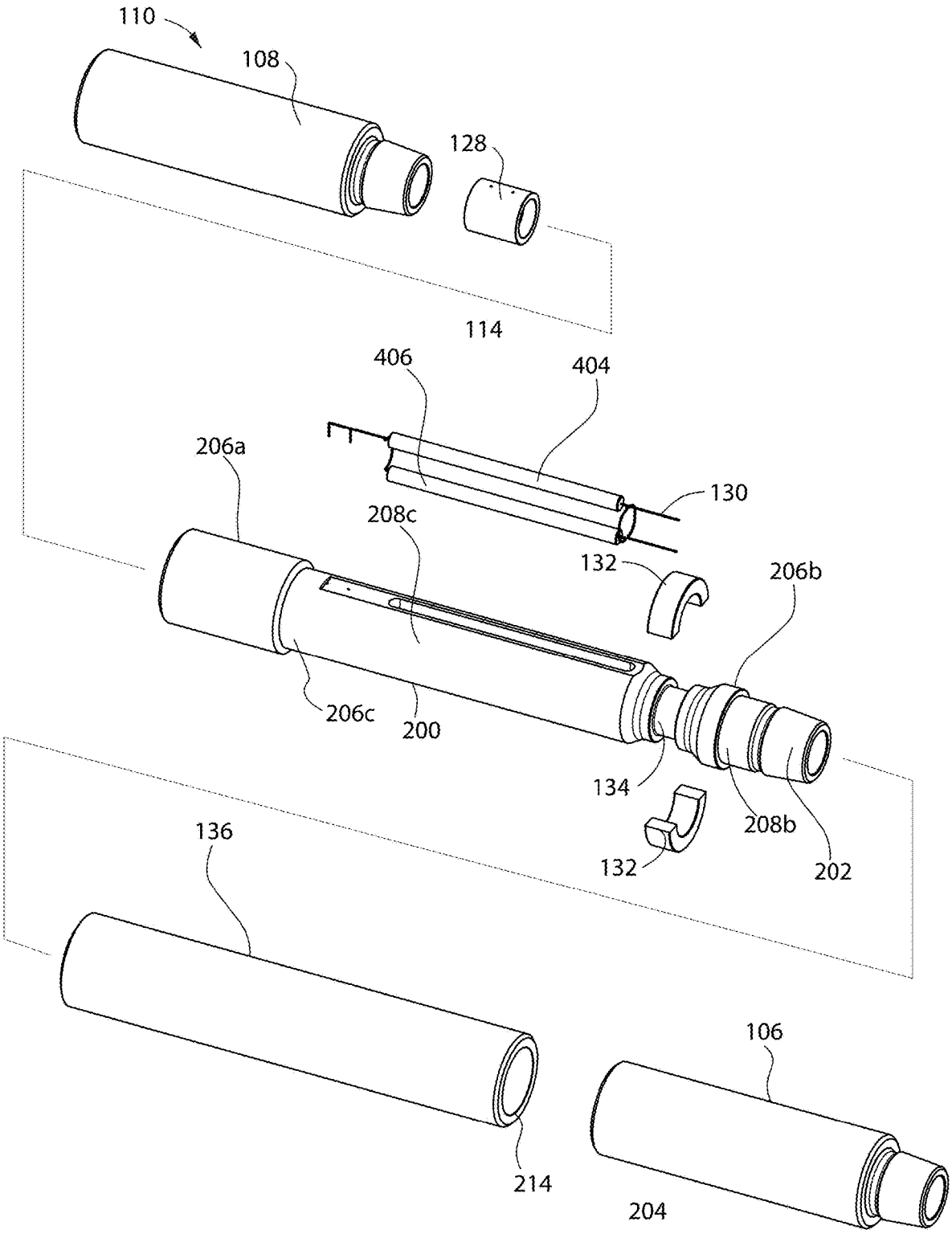
FIG. 4A illustrates an exploded view of a tubular disconnect assembly having an ignition assembly that includes a power pack.

FIG. 4A illustrates an exploded view of a tubular disconnect assembly having an ignition assembly that includes a power pack. The tubular disconnect assembly 110 may include a seating sub 108, a parting sub 200, a receiver 128, electrical wires 210, sleeve 136, charges 132, grooves 402, a process controller 404, a power pack 406, and an end cap 106. Referring to FIGS. 1A-D and FIG. 4A, the components may be assembled as follow. The seating sub 108 may be cylindrical tubular having a pin 218. The pin 218 may be abutted against a receiver 128. The receiver 128 may be slid into parting sub 200. Additionally, the parting sub 200, may have a seat (not shown) upon which the receive 128 may be seated. The pin 218 of the seating sub 136 may have pin threads for coupling to box threads in the box (not shown) of the parting sub 200. Thus, when the seating sub 108 is couple to the parting sub 200, the pin 218 of the seating sub 108 may be abutted against the receiver 128. Consequently, the receiver may also remain abutted to the seat of the parting sub 200. The receiver 128 may be coupled to electrical wires 210. The electric wires 210 may be coupled to the controller 404 and the power pack 406. The controller 404 and the power pack 406 may be disposed in grooves 402 of the parting sub 200. Additionally, the electrical wires may be coupled to or embedded in the charges 132. The charges 132 may be disposed in a decoupling portion 134 of the parting sub 200.

The sleeve 136 may be slidably coupled to the parting sub 200. From the lower end of the parting sub 200, the sleeve 136 may be slid over a portion of the parting sub 200 until an upper lip of the sleeve is abutted against the upper collar 206*a* of the parting sub 200. The sleeve 136 may cover the controller 404, the power pack 406, the electrical wires 210, and the charges 132.

Additionally, a threaded pin 202 of the parting sub 200 may be extended through a lower end of the sleeve 136. The threaded pin 202 may be coupled to a threaded box 204 of the end cap 106. When the parting sub 200 and the end cap 106 are coupled, a lip of the box 204 may be abutted against a lower collar 206*b* of the parting sub 200 and the lower end of the sleeve 136.

In various versions, the parting sub 200 of FIG. 4A may include a castellated upper collar and a socket head for respective coupling with a castellated collar and a socket of a sleeve 136 as described above corresponding to FIG. 2B In other versions, the parting sub 200 of FIG. 4A may include an upper socket head and a lower socket head for respective coupling with an upper socket and a lower socket of a sleeve 136 as described above corresponding to FIG. 2C FIG. 4B illustrates a cross-cut view of a tubular disconnect assembly having a controller 404 disposed in a first groove 408*a* and a power pack 404 disposed in a second groove 404*b*. The grooves 408*a*, 408*b* may be disposed in a parting sub 200. The controller 404 and the power pack 406 may be covered by a sleeve 136.

Figure 4B:
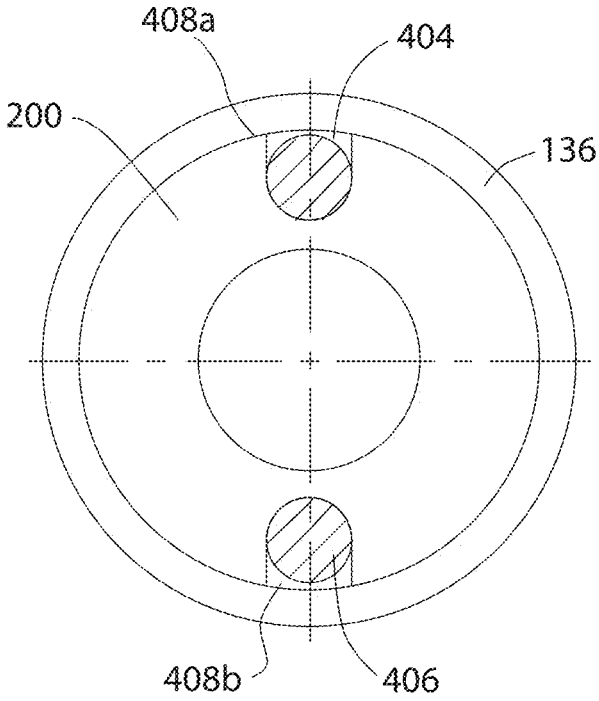
FIG. 4B illustrates a cross-cut view of a tubular disconnect assembly having a controller disposed in a first groove and a power pack disposed in a second groove.
Figure 4C:
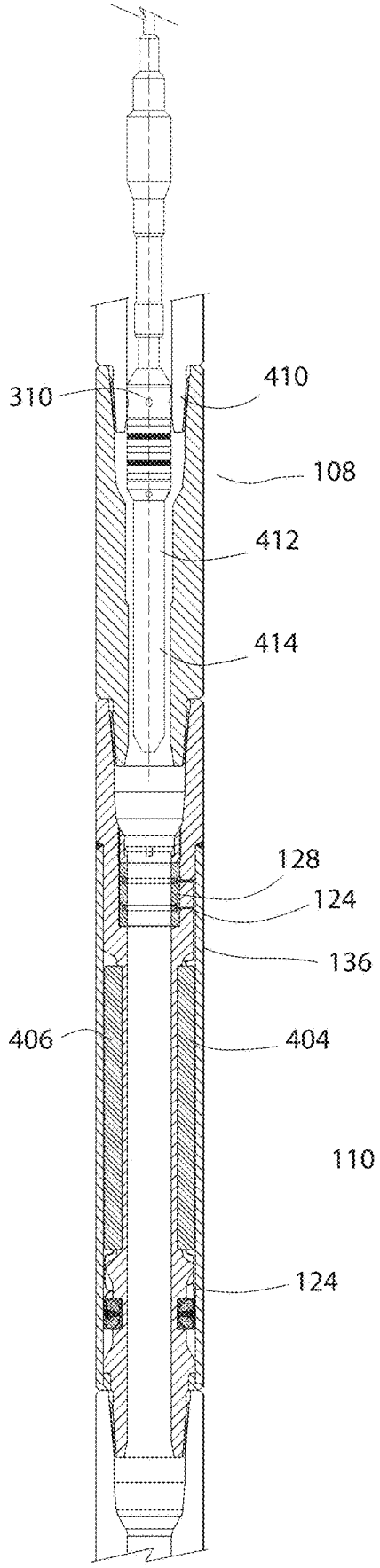
FIG. 4C illustrates a cross-sectional view of a tubular disconnect assembly having a process controller and a power pack disposed in grooves of a parting sub.

FIG. 4C illustrates a cross-sectional view of a tubular disconnect assembly 110 having a controller and power pack disposed in a parting sub 200. The tubular disconnect assembly may receive a dart assembly 114.

Figure 5:
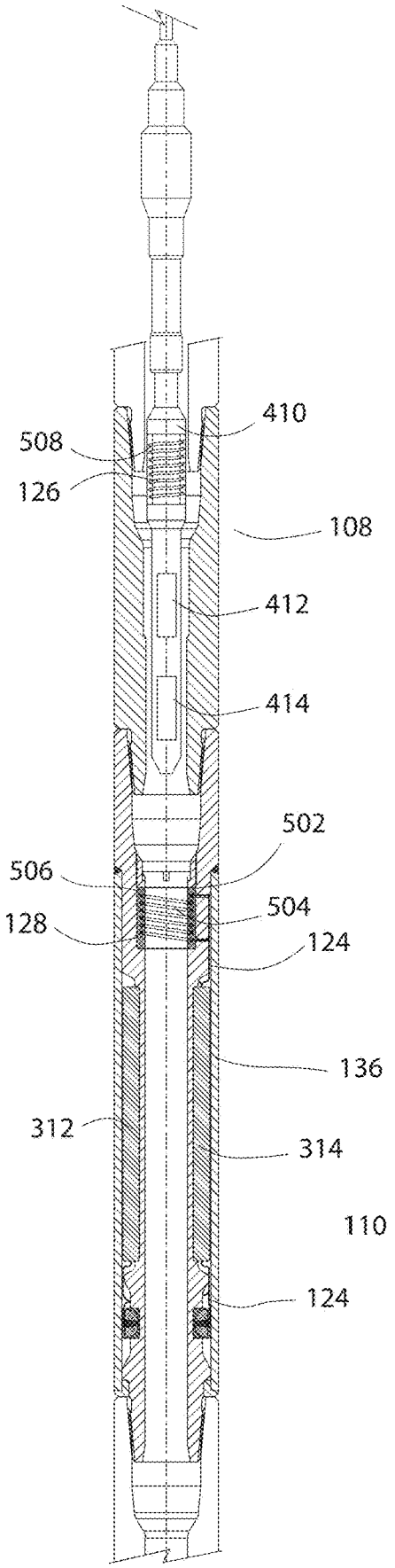
FIG. 5 illustrates a cross-sectional view of a tubular disconnect assembly having an ignition assembly having an inductive receiver.

FIG. 5 illustrates a cross-sectional view of a tubular disconnect assembly having an inductive transmitter 126 and an inductive receiver 128. The inductive transmitter 126 may include an inductive transmitting coil 508 wound around the housing 120 of an actuation assembly 118. The receiver 128 may include an inductive receiving coil 504 wound around the receiver 128.

Figure 6:
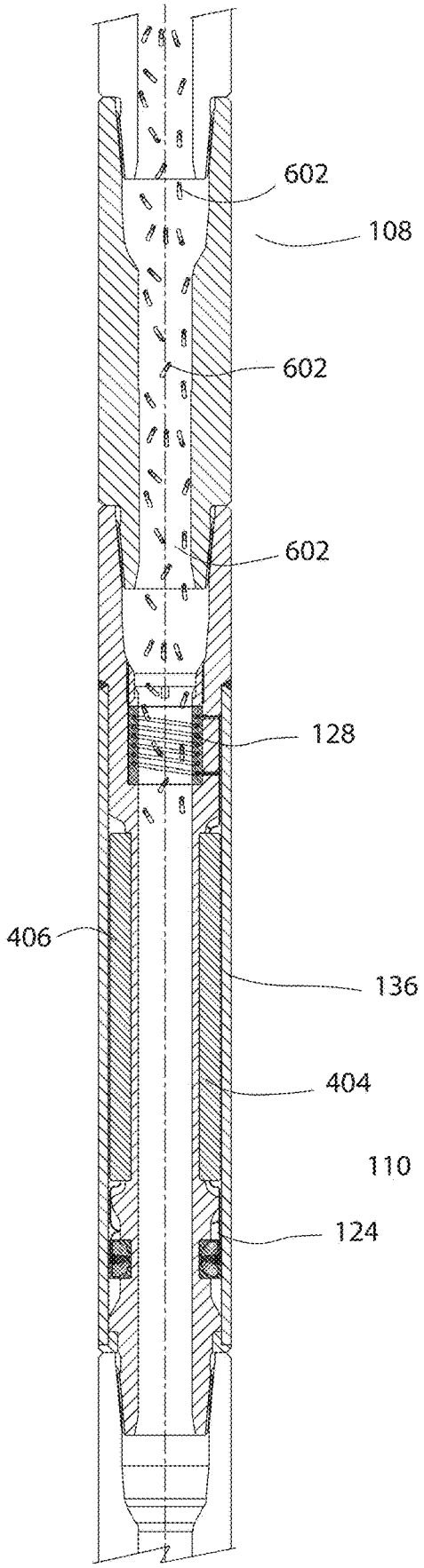
FIG. 6 illustrates a cross-sectional view of a tubular disconnect assembly having a receiver for receiving signals from RFID tags passed through the tubular disconnect assembly.

FIG. 6 illustrates a cross-sectional view of a tubular disconnect assembly 110 having a receiver 128 for receiving signals from RFID tags 602 passed through the tubular decoupling assembly 110.

Referring to FIGS. 1B-C, FIGS. 3B-C, and FIGS. 4A-C, an operator may deploy a dart assembly 114, e.g., via wireline, down a stuck drill string 102 to sever the drill string 102. The dart assembly 114 may descend downhole by pump pressure or in free-fall. Once a trigger assembly 116 of the dart assembly 114 lands on a seating sub 108, a transmitter 126 of an actuation assembly of the dart assembly 114 may be aligned with a receiver 128 of an ignition assembly 124 disposed on a parting sub 200. Additionally, the transmitter 126 and the receiver 128 may be in physical contact with each other to provide for electrical conductance there between. In some cases, the transmitter 126 and the receiver 128 may be in physical contact with each other.

Once the operator receives an indication, e.g., via a pressure increase in the drill string, that the dart assembly 114 has landed on the seating sub 108, the operator may send a signal down a wireline to actuate the switch 310.

Alternatively, for a dart assembly 114 having a slidable piston 320, the operator may increase downward fluid pressure in the drill string against the piston 320. At a threshold pressure, the piston 320 may be sheared from the housing of the trigger assembly 116. The sheared piston 320 may be slid down the housing of the trigger assembly 116 until it is abutted against a switch 310. Furthermore, the piston 320 may be slid away from fluid ports 322 of the housing of the trigger assembly 116. Fluid may exit the fluid ports 322 providing indication, e.g., via a pressure drop in the drill string, to the operator to pull on and apply torque to the drill string.

Next, the actuated switch 310 may activate the process controller 312. The process controller 312 may step through an ignition protocol. Among other conditions, the ignition protocol may require acknowledgement that the switch 310 has been actuated. Another condition may be that the transmitter 126 and the receiver 128 are in electrical communication through a feedback loop. If the protocol is satisfied, the process controller 312 may complete a circuit through which electrical power from power pack 314 may be transmitted, e.g., electric wires, to the transmitter 126. Upon receiving the electrical energy, the transmitter 126 may transmit an ignition signal to the receiver 128 of the ignition assembly 124.

In some versions, as shown in FIG. 5, an ignition signal may be transmitted via an inductive transmitter 126 and received by an inductive receiver 128.

In other versions, instead of deploying a dart, an operator may deploy RFID tags down the drill string 102 to pass through a receiver 128, as shown in FIG. 6. The receiver 128 may passively receive an ignition signal emitted from each RFID tag. Alternatively, the receiver 128 may actively communicate with the RFID tags.

Once the receiver 128 receives an ignition signal, the receiver 128 may transfer the signal to a process controller 404. The process controller 404 may step through an ignition protocol. Among other conditions, the ignition protocol may require acknowledgement that the transmitter 126 and receiver 128 are in electrical communication through a feedback loop. An alternative condition may be a threshold number of signals received from RFID tags deployed. If the protocol is satisfied, the process controller 404 may complete a circuit through which electrical power from power pack 406 may be transmitted, e.g., electric wires, to the initiator heads (not shown) embedded in charges 132 disposed on a decoupling portion 134 of a parting sub 200. The initiator heads may ignite the charges 132 to cut the decoupling portion 134. Preferably, the initiator heads ignite the charges 132 simultaneously at multiple radial locations around the decoupling portion 134.

In some cases, the charges 132 may cut completely through the decoupling portion 134, thereby severing the drill string 102 into an upper drill string portion and lower drill string portion. In other cases, the charges 132 may not cut completely through the decoupling portion 134. However, the pull force and torque applied to the drill string may cause the decoupling portion 134 to break and/or tear, thereby also severing the drill string 102 into an upper drill string portion and lower drill string portion.

A version of a tubular disconnect assembly 110 is described below in reference to FIGS. 2A-B. The disconnect assembly 110 may include a parting sub 200. The parting sub 110 is shown to include a sacrificial mandrel 200 having a relatively thin wall section 134. The thin wall section 134 may have one or more outer diameters substantially less than the collar diameter. Cutting charges 132 may be mounted on the periphery of the thin wall section 134. The lower end of the sacrificial mandrel 200 has a male threaded endpin 202 for mating with a female threaded box 204 on the drill string lower section 106.

The thin wall section 134 may be located between and share an axial flow bore with three stepped bosses 206*a-c* there through. The first stepped boss 206*a* may locate at the upper end of the sacrificial mandrel 200. The second stepped boss 206*b* may locate at the lower end of the sacrificial mandrel 200, axially opposite the first stepped boss 206*a* from the thin wall section 134 and adjacent to the male threaded endpin 202. The third stepped boss 206*c* may be locate axially between the thin wall section 134 and first stepped boss 206*a*.

The larger diameter of the first stepped boss 206*a* may essentially have a similar diameter as the drill string 102. The thin wall section 134 has one or more diameters relatively smaller than the smallest diameter of the three steps of the stepped bosses.

The outer diameter of the second stepped boss 206*b* and third stepped boss 206*c* may be dimensioned to, respectively, to receive the upper inside diameter and lower inside diameter of the sleeve 136 with a slip-fit overlay. The third stepped boss 206*c* preferably has a similar diameter as the second stepped boss 206*b*. However, in alternative versions of the disclosed apparatus, the third stepped boss 206*c* and second stepped boss 206*b* may have outer diameters of differing values.

As shown in FIG. 2B, a first boss riser face 210 may be disposed between the first stepped boss 206*a*. The third stepped boss 206*c* may be cut with a castellation profile for meshing with a corresponding castellation profile on a sleeve collar 216*a* on the first end of the sleeve 136. The second tread 208*b* of the second stepped boss 206*b* may be formed with chordal wrench flats 212 corresponding to the wrench flats 214 in a sleeve collar 216*b* on the second end of sleeve 136.

FIG. 2C shows an alternate version of a tubular disconnect assembly 110 having no castellation profiles. Instead, the third tread 208*c* of the third stepped boss 206*c* may be formed with chordal wrench flats 212*a* corresponding to wrench flats 214*a* in a sleeve collar 216*a* on the first end of the sleeve 136. The second tread 208*b* of the second stepped boss 206*b* may be formed with chordal wrench flats 212*b* corresponding to the wrench flats 214*b* in the sleeve collar 216*b* on the second end of sleeve 136.

A drill string lower section 106 may be constructed with a female threaded box 204 matching the male threaded endpin 202 on the sacrificial mandrel 200. When engaging the threads of the drill string lower section 106 with corresponding threads of the parting sub 110, the end-pin of the female threaded box 204 abuts of the lower collar face of the sleeve 136 to assist in compressing the sleeve 136 against the riser face of the first boss 206*a*. When the threads are in full engagement, the ends of the sleeve 136, riser face of the first stepped boss 206*a*, and the endpin of the female threaded box 204 are in compressed juxtaposition and firmly secured. Thus, the dominance of all torsional stress transferred by the seating sub 108 to the sacrificial mandrel 200 may be carried by the sleeve 136.

Another version of a tubular disconnect assembly 110 is described below in reference to FIGS. 3A-B. tubular disconnect assembly 110 includes a power supply comprising a plug member 116, body section 118, and a dart section 120. A transmitter 126 may radially mount onto the outer diameter of the body section 118 to transfer electrical energy to the receiver 128 on the sacrificial mandrel 200. A threaded female mating profile 302 may be formed in the upper end of the body section 118 for mating with a threaded male mating profile 304 on the lower end of the plug member 116. The plug member 116 may have a through-bore through which a wireline 306 may traverse. Also, the plug member 116 may have an external shoulder 308 to land on plug seat 112. Furthermore, the plug member 116 may utilize a slotted outer diameter to allow fluid bypass. The landing of the plug member 116 with the plug seat 112 may provide appropriate location of the transmitter 126 with the receiver 128 within the bore of the tool.

Referring to the cross-sectional view of FIG. 3B, the ignition switch 310 may install at the base of the threaded female mating profile 302. The wireline 306 may attach to the ignition switch 310, which may receive an electrical signal from the wireline 306. The ignition switch 310 may connect, via electrical wires, to activate a process controller 312 fitted in the dart section 120. The process controller 312 may be preprogrammed with an ignition protocol to control precisely when a power source 314 delivers energy to the transmitter 126, preventing unexpected or premature ignition of the cutting charges 132.

Fluid ports 316 may extend from an upper portion of the body section 118, through the wall of the body section 118, and out through a lower portion of the body section 118. Each fluid port 316 may provide for wellbore fluid to enter a lower opening and escape through an upper opening to reduce impedance to the descent of the power supply 114. Fluid ports 316 may also circulate fluid through the drill pipe after the upper drill string is disconnected from lower drill string.

Alternatively, the direction of fluid entry and egress may reverse if the power supply 114 is tethered to and is withdrawn by a wireline or slickline. In such instances, wellbore fluid flowing through the fluid ports 316 may be prevented from causing swabbing and kicking as the power supply 114 withdraws from the drill string.

During operation, an operator may launch the power supply 114, on wireline 306, into a stuck drill string 102. The power supply 114 may descend by pump pressure or in free-fall. Once the plug member 116 on the power supply 114 lands on the plug seat 112, the transmitter 126 and receiver 128 align to permit electrical communication. A pressure increase may indicate that the power supply 114 has landed; at which point, the operator may send an ignition signal down the wireline to actuate the ignition switch 310. The actuated ignition switch 310 completes an electrical circuit on the power supply to activate the process controller 312.

Next, the process controller 312 may step through an ignition protocol. Among other conditions, the ignition protocol may require acknowledgement that the ignition switch 310 has been actuated and the transmitter 126 and receiver 128 are in electrical communication through a loopback function. If the protocol is satisfied, the process controller 312 may instruct the power source 314 to send electrical energy to the transmitter 126, which then transmits the electrical energy to the receiver 128 on the ignitor 124. The electrical energy may further transmit across electrical wires of the ignitor 124 to initiator heads (not shown) in the cutting charges 132. Upon receiving the energy, the initiator heads may ignite the cutting charges 132, preferably simultaneously at multiple radial locations around the thin wall section 134. The ignited cutting charges 132 may undergo a chemical reaction to generate and discharge either very high temperature molten jets, high velocity plasma jets, or corrosive jets towards the outer surface of the thin wall section 134, thereby cutting and/or parting and/or separating the sacrificial mandrel 200.

The operator may apply torque and/or upward tension on the drill string to separate the upper drill string 102 section from the parting sub stub 138.

In an alternate version, as illustrated in FIGS. 3C-D, the ignition switch 310 may be actuated by a compatible actuation tool 318 incorporated onto the power supply 114. The compatible actuation tool 318, having a plug member 116, mates to the upper body section 118 of the power supply 114. Furthermore, the compatible actuation tool 318 has a piston 320 that may be driven through the plug member 116 to abut and actuate the ignition switch 310.

During operation, an operator may launch at surface a power supply 114, having the compatible actuation tool 318 attached, as an untethered, independent assembly. The power supply 114 may descend by pump pressure or in free-fall. Once the plug member 116 on the power supply 114 lands on the plug seat 112, the transmitter 126 and receiver 128 may align to permit electrical communication.

A pressure increase may indicate that the power supply 114 has landed; at which point, the operator may further increase pressure above the plug member 116 beyond a threshold value to actuate the compatible actuation tool 318 to drive the piston 320 downward to abut and actuate the ignition switch 310. The actuated ignition switch 310 may complete an electrical circuit on the power supply to activate the process controller 312. The succeeding sequences to ignite and cut the thin wall section 134 mirror that of the first version previously described.

In other versions, the compatible actuation tool 318 may be attached to and lowered by a slickline to allow withdrawal of the power supply 114.

Referring to the views of FIG. 4A-C, an additional version of a tubular disconnect assemblies 110 may have a power supply 114 integrated on the periphery of the sacrificial mandrel 200 to accompany the drill pipe downhole during drilling operation. The advantage of integrating a power supply on the drill pipe allows for delivery of a smaller ignition assembly 410 to transmit an ignition signal to the power supply 114. The ignition assembly 410 may have a profile, components, and function similar to that of the power supply 114 and its alternative versions previously described in FIGS. 1-3.

The power supply 114 may comprise a process controller 404 and a power source 406 mounted on the periphery of the sacrificial mandrel 200 in groove 408*a* and 408*b*, respectively. The process controller may be preprogrammed with an ignition protocol to control precisely when the power source 406 delivers cutting energy to the ignitor 124 to prevent unexpected or premature ignition of the cutting charges 132. The arrangement of the power source 406 and process controller 404 on the periphery of the sacrificial mandrel is not limited to the aforementioned configuration so long as the power supply may be secured between the sacrificial mandrel 200 and sleeve 136.

Turning to the cross-sectional view of FIG. 4C, an ignitor 124 connects the power supply 402 and cutting charges 132 along electrical wires. The receiver 128 of the ignitor 124 may be mounted on the inner diameter of the upper section of the sacrificial mandrel 200 to receive an ignition signal. The ignitor 124 may connect to the power supply 114 along electrical wires, which also extends to initiator heads (not shown) embedded in the cutting charges 132.

FIG. 4C illustrates the ignition switch 310 on the ignition assembly 410 that may be activated via a connected wireline. The ignition switch 310 may be configured to receive an ignition signal directly from the wireline from surface.

In operation, the ignition assembly 410 may be deployed via pump pressure or free-fall. Once the ignition assembly 410 seats on the plug seat 112, the transmitter 126 and the receiver 128 may be aligned to establish electrical communication therebetween. A pressure increase may indicate that the ignition assembly 410 has landed; at which point, the operator may choose to send an ignition signal down the wireline to actuate the ignition switch 310. The actuated ignition switch 310 may complete an electrical circuit on the ignition assembly to activate the ignition assembly process controller 412. The ignition assembly process controller 412 may step through an ignition protocol. Among other conditions, the ignition protocol may require acknowledgement that the ignition switch 310 has been actuated and the transmitter 126 and receiver 128 are in communication. If the protocol is satisfied, the ignition assembly process controller 412 may instruct the ignition assembly power source 414 to propagate the ignition signal to the transmitter 126, which then transmits the ignition signal to the receiver 128 on the ignitor 124.

Next, the process controller 404 may receive the ignition signal from the receiver 128, and steps through an additional ignition protocol to prevent unexpected or premature ignition of the cutting charges 132. If the protocol is satisfied, the process controller 404 instructs the power source 406 to deliver cutting power to the ignitor 124. The initiator heads receive the cutting power to ignite the cutting charges 132, preferably simultaneously at multiple radial locations on the thin wall section 134. The ignited cutting charges 132 undergo a chemical reaction to generate and discharge either high-temperature molten jets, high-velocity plasma jets, or corrosive jets towards the outer surface of the thin wall section 134, thereby cutting the sacrificial mandrel 200.

What is claimed as the invention is:

1. A downhole tubular disconnect assembly, comprising:
- a parting sub having a decoupling portion;
- a cutting charge coupled to an outer surface of the decoupling portion;
- an ignition assembly coupled to the parting sub and the cutting charge;
- a sleeve disposed over the decoupling portion of the parting sub and the cutting charge; and
- an end cap coupled to the parting sub and abutted against the sleeve.

2. The downhole tubular disconnect assembly of claim 1, wherein when the cutting charge is ignited, material from the cutting charge is directed towards a central axis of the parting sub.

3. The downhole tubular disconnect assembly of claim 1, wherein the parting sub, sleeve, and end cap are coaxial.

4. The downhole tubular disconnect assembly of claim 1, wherein the ignition assembly further comprises a receiver coupled to an inner surface coupled to the parting sub above the cutting charge, wherein the receiver is capable of receiving power from an actuator assembly without physical contact with actuator assembly.

5. The downhole tubular disconnect assembly of claim 1, further comprising an actuator assembly capable of transferring igniting power to the ignition assembly.

6. The downhole tubular disconnect assembly of claim 1, wherein
- the parting sub further comprises:
  - a first socket head; and
  - a second socket head; and
- the sleeve further comprises:
  - a first socket slidably coupled to the first socket head of the parting sub; and
  - a second socket slidably coupled to the second socket head of the parting sub.

7. The downhole tubular disconnect assembly of claim 1, wherein
- the parting sub further comprises:
  - a castellated lip; and
  - a socket head; and
- the sleeve further comprises:
  - a castellated lip slidably coupled to the castellated lip of the parting sub; and
  - a socket slidably coupled to the socket head of the parting sub.

8. The downhole tubular disconnect assembly of claim 1, further comprising a seating sub capable of seating an actuator assembly.

9. The downhole tubular disconnect assembly of claim 1, further comprising a seating sub coupled to an upper portion of the parting sub.

10. A downhole tubular disconnect assembly for coupling and later decoupling of a first downhole tubular and a second downhole tubular, comprising:

a parting sub having a decoupling portion and a groove;

a cutting charge coupled to an outer surface of the decoupling portion;

an ignition assembly coupled to the parting sub and the cutting charge, the ignition assembly comprising:

a receiver coupled to an inner surface of the parting sub;

a controller disposed in the groove of the parting sub and coupled to the receiver;

a power pack disposed in the groove of the parting sub;

an ignition head capable of igniting the cutting charge; and a sleeve covering the decoupling portion of the parting sub and the cutting charge; and an end cap coupled to the parting sub and abutted against the sleeve.

11. The downhole tubular disconnect assembly of claim 10, wherein the sleeve covers the decoupling portion of the parting sub, the cutting charge, and the power pack.

12. The downhole tubular disconnect assembly of claim 10, wherein the controller of the power supply is capable of receiving a signal from a receiver of the power supply assembly.

13. The downhole tubular disconnect assembly of claim 10, wherein the controller of the power supply is capable of receiving igniting power from the power pack of power supply assembly.

14. The downhole tubular disconnect assembly of claim 10, wherein the controller of the power supply is capable of transmitting igniting power to the ignition head of the power supply assembly.

15. The downhole tubular disconnect assembly of claim 10, further comprising an actuator assembly capable of transmitting an ignition signal to the controller.

16. The downhole tubular disconnect assembly of claim 10, further comprising an actuator assembly, comprising:

a power pack;

a controller coupled to the power pack and capable of receiving power from the power pack, a transmitter coupled to the controller and capable of transmitting an ignition signal; and a switch coupled to the controller.

17. A method of disconnecting a first tubular and a second tubular, comprising:

coupling a downhole tubular disconnect assembly between the first tubular and the second tubular, wherein the downhole tubular disconnect assembly comprises:

a parting sub;

a cutting charge coupled to an outer surface of the parting sub;

an ignition coupled to the cutting charge; and a sleeve disposed over the cutting charge;

deploying a dart in the parting sub;

sending a signal from the deployed dart to the ignition assembly to ignite the cutting charge; and directing material from the ignited cutting charge against the outer surface of the parting sub.

18. The method of claim 17, further comprising cutting the parting sub with material from the ignited cutting charge.

19. The method of claim 17, further comprising eroding the parting sub with material from the ignited cutting charge.

20. The method of claim 17, further comprising corroding the parting sub with material from the ignited cutting charge.

* * * * *